United States Patent [19]

Lewis

[11] 4,227,353

[45] Oct. 14, 1980

[54] BUILDING CONSTRUCTION

[75] Inventor: Ronald H. Lewis, Southport, Australia

[73] Assignee: Jess Lewis, Southport, Australia; a part interest

[21] Appl. No.: 952,927

[22] Filed: Oct. 19, 1978

[51] Int. Cl.[2] ..... E04D 13/06; E04C 1/39

[52] U.S. Cl. ..... 52/15; 52/82; 52/95

[58] Field of Search ..... 52/81, 94, 95, 13, 14, 52/15, 18, 82

[56] References Cited

U.S. PATENT DOCUMENTS

| | | | |
|---|---|---|---|
| 3,014,558 | 12/1961 | Noyes | 52/82 |
| 3,090,162 | 5/1963 | Baroni | 52/13 |
| 3,111,786 | 11/1963 | Wasserman | 52/22 |
| 3,206,895 | 9/1965 | DeRidden | 52/15 |
| 3,475,768 | 11/1969 | Burton | 52/82 |
| 3,611,649 | 10/1971 | Muller | 52/14 |
| 3,774,358 | 11/1973 | Hale | 52/81 |

FOREIGN PATENT DOCUMENTS

| | | | |
|---|---|---|---|
| 2275608 | 1/1976 | France | 52/94 |

*Primary Examiner*—John E. Murtagh

*Attorney, Agent, or Firm*—Schwartz, Jeffery, Schwaab, Mack, Blumenthal & Koch

[57] ABSTRACT

A building roof consists of an assembly of adjacent roofing units, each comprising a pyramid-shaped main section of which the lower edges lead into, and are secured to, a rectangular peripheral assembly of channel ducts, the adjacent ducts of succeeding units being connected and sealed. Fascia units are secured to and extend outwardly from the outer flanges of the channel ducts about the periphery of the roof, each fascia unit having a sloping top substantially co-planar with the pyramid surface secured to the inner flange of the duct, a substantially vertical outer face, and a substantially horizontal bottom leading back to and seated on an exterior wall of the building supporting the roof.

6 Claims, 6 Drawing Figures

10
11
35
36
37
38
39
40
41
42
43
44
45
46
5
6

BUILDING CONSTRUCTION

BACKGROUND OF THE INVENTION

This invention relates to a building construction, and more particularly to roofing for houses or other buildings.

The general object of the invention is to provide a system of roofing whereby considerable economies may be achieved, not only in the construction of the roof but also in the ceilings and walls.

SUMMARY OF THE INVENTION

Broadly, the invention resides in a roof for a building including a plurality of adjacent roofing units each comprising a pyramid-shaped main section, its lower edges secured to and leading down into a rectangular peripheral assembly of channel ducts; means supporting the corner portions of the rectangular assembly of channel ducts; and means connecting in sealed manner the adjacent channel ducts of successive roofing units. Preferably fascia units extend outwardly from the periphery of the roof, each being secured to the outer flange of a channel duct and having a sloping top which is substantially co-planar with the pyramid surface secured to the inner flange of the duct, the fascia unit also having an upright outer face and a substantially horizontal bottom leading back to and seated on the exterior wall of the building, to constitute a soffit. Other features of the invention will become apparent from the following description.

BRIEF DESCRIPTION OF THE DRAWINGS

In order that the invention may be readily understood and carried into practical effect, reference is now made to the accompanying drawings, wherein.

DESCRIPTION OF THE PREFERRED EMBODIMENTS

The roofing system includes a series of pyramid-shaped main sections 10 in each of which the bottom edge portions are secured to, and slope down into, a peripheral system of load-bearing channel ducts 11 supported at their ends by piers 12.

The pyramid-shaped main sections 10 and their peripheral ducts 11 are supported adjacently to suit the requirements of the building, and are square or rectangular in plan view. About the exterior walls of the building, a system of fascia units 13 is assembled, the upper faces of these units continuing the slope of the surfaces of the pyramid-shaped main sections which lead down to these fascia units, the peripheral ducts 11 of the main sections serving as gutters for the roofing system.

Figure 1:
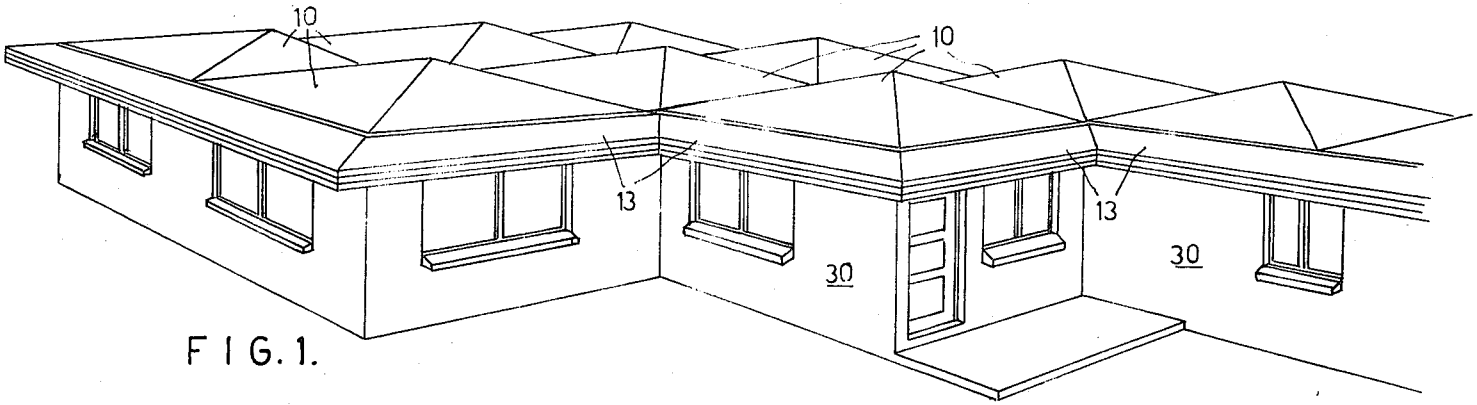
FIG. 1 is a perspective view of part of a house incorporating a roofing system according to the invention.
Figure 2:
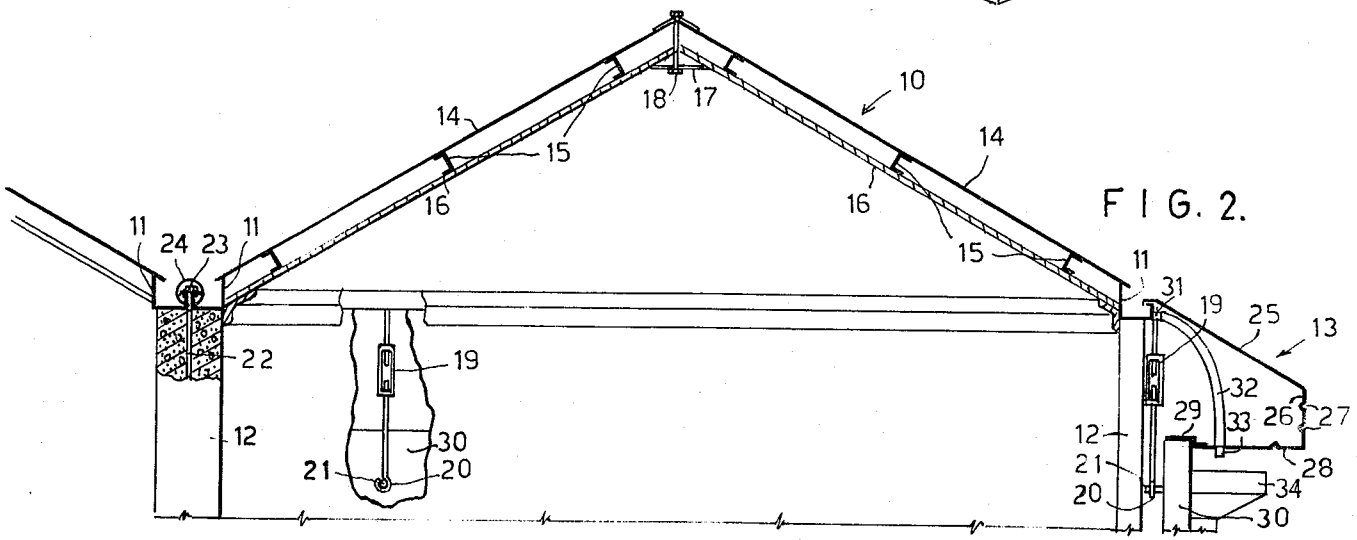
FIG. 2 is a sectional view of part of the house.

The pyramid-shaped main sections 10 may be constructed in any of a number of ways. For example, they may be made of galvanized sheet steel sections 14 welded together and, as shown in FIG. 2, reinforced by channel sections 15 welded to their under-surfaces. Each of the four triangular faces of the pyramid may be composed of a single sheet metal section, or of several sections welded or otherwise secured together, and the lower edge of each of the triangular faces is welded or otherwise secured to the top of the inside flange of a channel duct 11, the four peripheral ducts of the unit being mitred and welded together at the corners. Ceiling sheets 16 are secured in any suitable manner to the reinforcing channel sections 15 and are supported, at the apex of the pyramidal ceiling structure, by an apex support plate 17 held by a bolt through the apex of the roof assembly.

The units of the roofing system are anchored to the walls of the building by turnbuckle devices 19 welded at their upper ends to the outer flanges of the channel ducts 11 and having, at their lower ends, hooks 20 engaged with pins 21 secured in the wall structures. Where two or more channel ducts 11 of roofing units are supported by a common pier 12, a bolt 22 embedded in the pier and extending up from its top is located between the ducts and held to them by a cap and nut, as indicated at 23. The junctions of adjacent ducts are waterproofed by a seal 24, which may be a longitudinally divided tube of resilient material engaged over the two adjacent duct flanges.

The fascia units 13 are formed of sheet metal each having its top inner edge engaged and secured to the other flange of a channel duct 11, this outer flange of the duct being of lesser height than the inner flange so that the inclined top 25 of the fascia unit is substantially co-planar with the surface of the main section 10 from which it leads. The outer face 26 of the fascia unit is substantially vertical with longitudinal reinforcing grooves at 27. The bottom of the fascia unit is substantially horizontal, to form a soffit 28, the inner edge of which is secured to a mounting strip 29 seated and secured on top of the external wall 30 of the building, serving also as a lintel for the windows of the building.

Outlets 31 from the outer flanges of ducts 11 are connected by flexible hoses 32 to discharge outlets 33 from the soffit 28, leading to down-pipes 34.

The external walls 30 of the building require to be no higher than is necessary to support the mounting strips 29 of the fascia units 13 and therefore a good deal of expense may be saved in the construction of these walls.

Figures 3, 4, 5, 6:
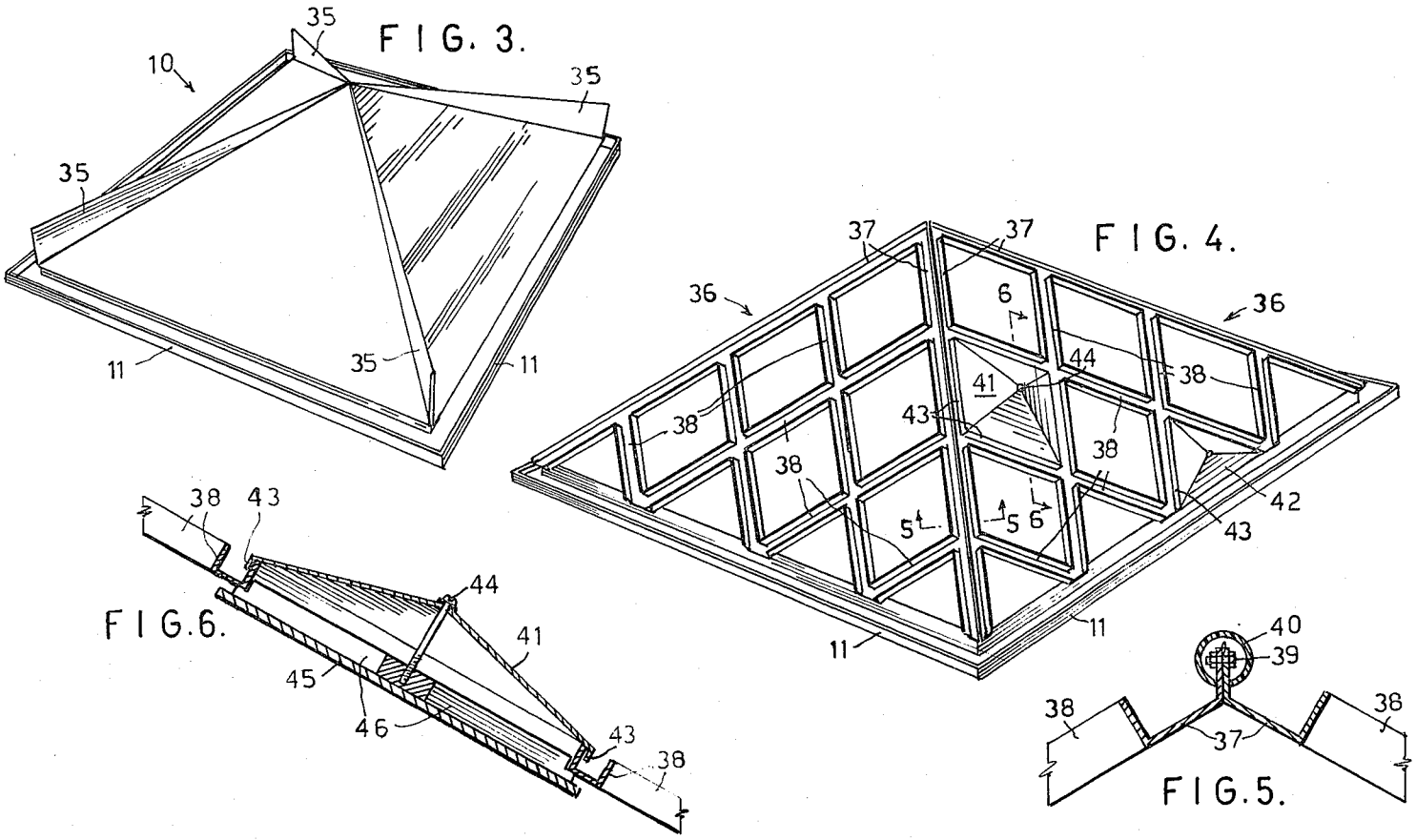
FIG. 3 is a perspective view of a part of the roof according to a modified form of the invention.
FIG. 4 is a perspective view of part of the roof according to another modification of the invention.
FIG. 5 is a sectional view along line 5—5 in FIG. 4.
FIG. 6 is a sectional view along line 6—6 in FIG. 4.

The main sections 10 may be of modified form, as shown in FIGS. 3 to 6 of the drawings. The embodiment shown in FIG. 3 is constructed of a single large section of sheet metal of square or rectangular shape, with integral reinforcing ridges 35 formed, and tapering, from all corners to the centre of the sheet, so that the initially flat sheet is drawn up into pyramidal form. As previously described, the lower edge portions of the pyramid-shaped structure are welded or otherwise secured to the inner flanges of the peripheral system of load-supporting channel ducts 11. If desired, further pressed ribs or corrugations may be formed to radiate from the centre of the sheet.

The embodiment shown in FIGS. 4, 5 and 6 includes a frame of pyramidal form composed of four substantially triangular sub-frames 36. Each of these sub-frames has two ridge channels 37 cut and welded to communicate at an angle at the top, and downwardly divergent, and a series of intermediate channels 38 in crossed arrangement, parallel to one or other of the ridge channels 37, all of the channels being cut and welded to communicate at their junctions.

The four sub-frames 36 are assembled into pyramid form, and, as shown in FIG. 5, the ridge channels 37 are such that the adjacent flanges of the ridge channels of succeeding sub-frames are made to lie closely to each other, and they are secured together by bolts 39 and sealed by a sealing strip 40 of longitudinally divided tubular resilient material. The lower ends of the ridge channels 37 and intermediate channels 38 are welded to the peripheral system of load-bearing ducts 11.

The four sub-frames 36 are assembled into pyramid form, and, as shown in FIG. 5, the ridge channels 37 are such that the adjacent flanges of the ridge channels of succeeding sub-frames are made to lie closely to each other, and they are secured together by bolts 39 and sealed by a sealing strip 40 of longitudinally divided tubular resilient material. The lower ends of the ridge channels 37 and intermediate channels 38 are welded to the peripheral system of load-bearing ducts 11.

The four sub-frames 36 are covered by four-sided tiles 41 and, along the lower parts, triangular tiles 42. These tiles may be of pressed metal and are of shallow four-sided or three-sided pyramidal form with downturned bottom edge flanges 43. Each of the four-sided tiles 41 is made to fit closely over the upstanding co-joined flanges of four of the channel members of the sub-frame, each of the triangular tiles 42 having two bottom edge flanges 43 engaging over two such channel flanges, its third bottom edge flange 43 extending into a duct 11.

Each of the tiles 41 or 42 is secured in place by a bolt 44 through its apex and engaged in a central tapped aperture in a ceiling tile 45 applied to the undersurface of the sub-frame 36. Each of the ceiling tiles, of appropriate four-sided or three-sided form has diagonal reinforcing members 46 on its upper surface, the tapper hole in which the bolt 44 is engaged being at the junction of these members. The ends of the diagonal reinforcing members 46 are stepped to engage with channel members of the sub-frame 36 in such manner that the ceiling tile 45 is held spaced below these channel members so that electrical wiring, for example, may be passed between the ceiling tiles and the sub-frame members. Rain falling on the tiles is carried off by the channel members of the sub-frames into the channel ducts 11.

Roofing constructions according to the invention will be found to be very effective in achieving the objects for which they have been devised. It will, of course, be understood that the particular embodiments of the invention herein described and illustrated may be subject to many modifications of constructional detail and design, which will be readily apparent to persons skilled in the art, without departing from the ambit of the invention hereinafter claimed.

We claim:

1. A roof for a building including:

a plurality of adjacently disposed roofing units each comprising a pyramid-shaped main section the lower edges of which are secured to and lead down into an assembly of channel ducts at the periphery of the roof, means supporting the corner portions of the assembly of channel ducts, means connecting in sealed manner the adjacent channel ducts of successive roofing units, fascia units engaged with the channel ducts at the periphery of the roof, each fascia unit including a top secured over the outer flange of a channel duct and substantially co-planar with an inclined surface of the pyramid-shaped main section, an upright outer part, and a substantially horizontal bottom part forming a soffit, and rainwater outlets from said channel ducts connected by conduits to discharge outlets on the soffit.

2. A roof for a building according to claim 1 wherein the inner edge portion of the soffit is connected to a strip overlying and secured to the top of external walls of the building which extend between said means supporting the corner portions of said channel ducts.

3. A roof for a building according to claim 1 further including ceiling members mounted under and parallel to all of the faces of the pyramid-shaped main section.

4. A roof for a building according to claim 1 wherein said pyramid-shaped main section comprises four co-joined triangular members of sheet material, and a series of spaced parallel substantially horizontal reinforcing members secured to the underside of each of said triangular members.

5. A roof for a building according to claim 1 wherein said pyramid-shaped main section comprises a single rectangular member of sheet material shaped to form ridges extending radially from the middle of the sheet.

6. A roof for a building according to claim 1 wherein said pyramid-shaped main section comprises four co-joined triangular sub-frames, each a grid of channel members communicating at their lower ends with the channel ducts, and tiles secured between said channel members.

* * * * *